US005361958A

United States Patent [19]

Fiegel et al.

[11] Patent Number: 5,361,958

[45] Date of Patent: Nov. 8, 1994

[54] GOLF CLUB CARRIER

[75] Inventors: Lester J. Fiegel, 5207 Valburn Cir., Austin, Tex. 78731; Ron B. Helton, 3102 Borden Rd., Austin, Tex. 78731

[73] Assignee: Lester J. Fiegel, Austin, Tex.

[21] Appl. No.: 120,295

[22] Filed: Sep. 13, 1993

[51] Int. Cl.[5] ..... B60R 9/00

[52] U.S. Cl. ..... 224/274; 224/918; 224/226

[58] Field of Search ..... 224/274, 918, 919, 277, 224/224, 226, 222, 253, 281, 278, 191, 234, 242; 206/315.2, 315.3, 315.5, 315.6

[56] References Cited

U.S. PATENT DOCUMENTS

| | | | |
|---|---|---|---|
| 3,010,628 | 11/1961 | Kowalczyk | 224/274 |
| 3,664,399 | 5/1972 | Neff | 150/1.5 R |
| 4,100,652 | 7/1978 | Carlson | 206/315.3 X |
| 4,449,310 | 5/1984 | Kline | 40/11 R |
| 4,497,404 | 2/1985 | Lowrance | 206/315.2 |
| 4,730,728 | 3/1988 | Larkin | 224/919 X |
| 4,838,416 | 6/1989 | Carman | 206/315.2 |
| 5,050,884 | 9/1991 | Flory | 273/162 R |
| 5,105,958 | 4/1992 | Patton | 224/274 X |
| 5,238,109 | 8/1993 | Smith | 206/315.2 |

*Primary Examiner*—Henry J. Recla
*Assistant Examiner*—David J. Walczak

[57] ABSTRACT

A small, tubular golf carrier that is easily fastened to a golf cart by using the attachment strap on the golf cart. The carrier lip is contoured for easy club access and the side of the carrier is curved for added stability when fastened to the cart.

4 Claims, 2 Drawing Sheets

GOLF CLUB CARRIER

BACKGROUND—FIELD OF INVENTION

This invention relates to a carrying device for a golf club.

BACKGROUND—DESCRIPTION OF PRIOR ART

Carriers for golf clubs are known in the art but known containers or devices do not provide for a secure, easy to use selection method for special clubs such as putters and drivers.

Golfers are always reaching for their special club and an easy to use method to provide separate accessibility is in demand.

Special clips and hooks that attach to golf bags have been proposed but these devices are difficult to use and not reliable when used in conjuction with a "pull" golf cart or a "motorized" golf cart. These devices are also bulky and difficult to set up and easily bounced off the golf bag when the bag is used with a cart.

OBJECTS AND ADVANTAGES

Accordingly objects and advantages of the golf club carrier we have described in our patent are:

(a) Provide a golf club carrier that is easily fastened to the golf cart when the golf bag is secured to the golf cart;

(b) Provide a golf club carrier that is small and is easily stored inside the golf bag when not in use;

(c) Provide a golf club carrier that is soft and semi-flexible and can be brightly colored for rapid identification;

(d) Provide a golf club carrier that keeps the special club (putter) separate from others thus damage free;

(e) Provide a golf club carrier that provides easy accessibility to special clubs such as a putter.

Still further objects and advantages will become apparent from a consideration of the ensuing description and drawings.

DRAWING FIGURES

REFERENCE NUMERALS IN DRAWING

10 golf club carrier

12 golf club carrier mounted

Figure 1A:
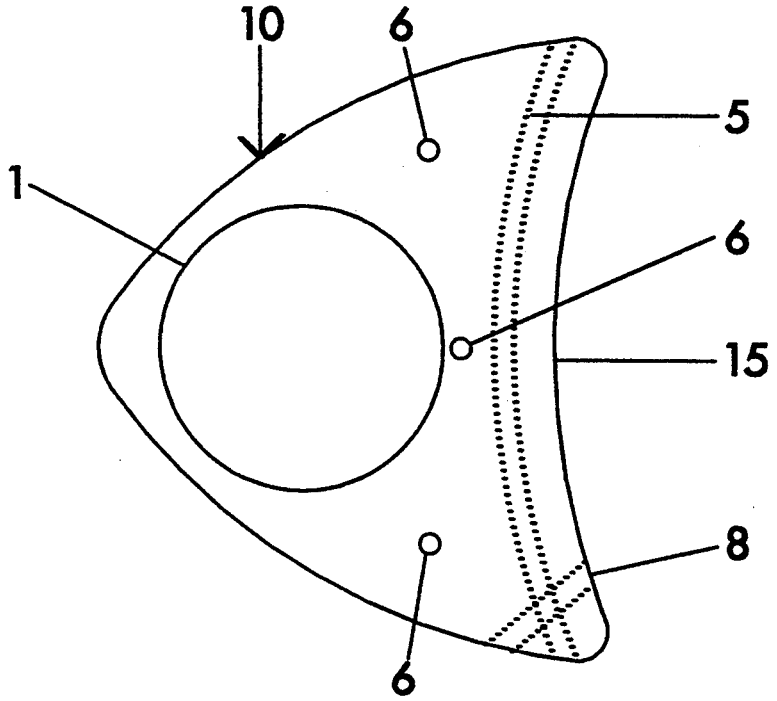
FIG. 1A and 1B show top and side views of the golf club carrier.
Figure 1B:
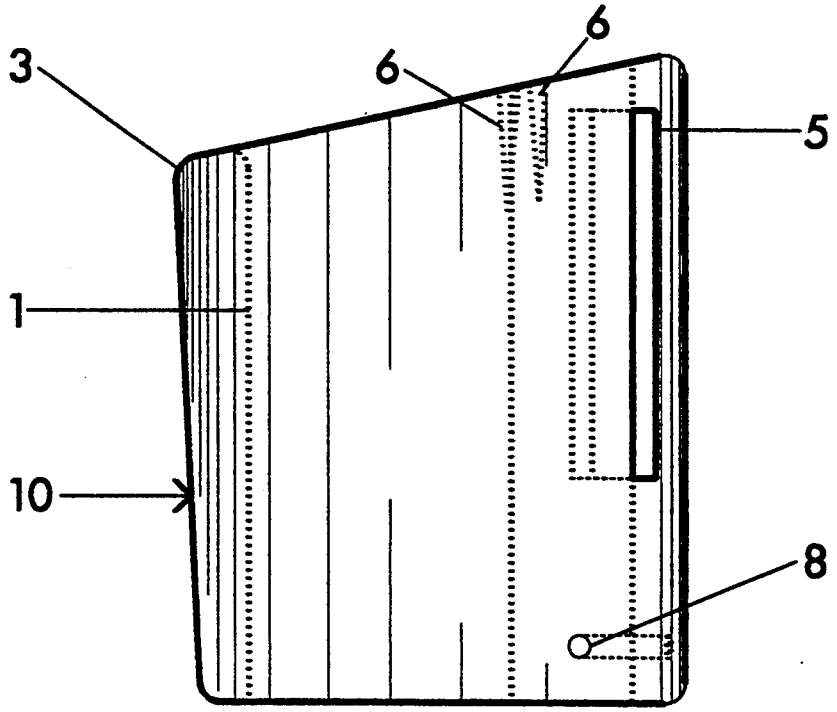
Figure 2:
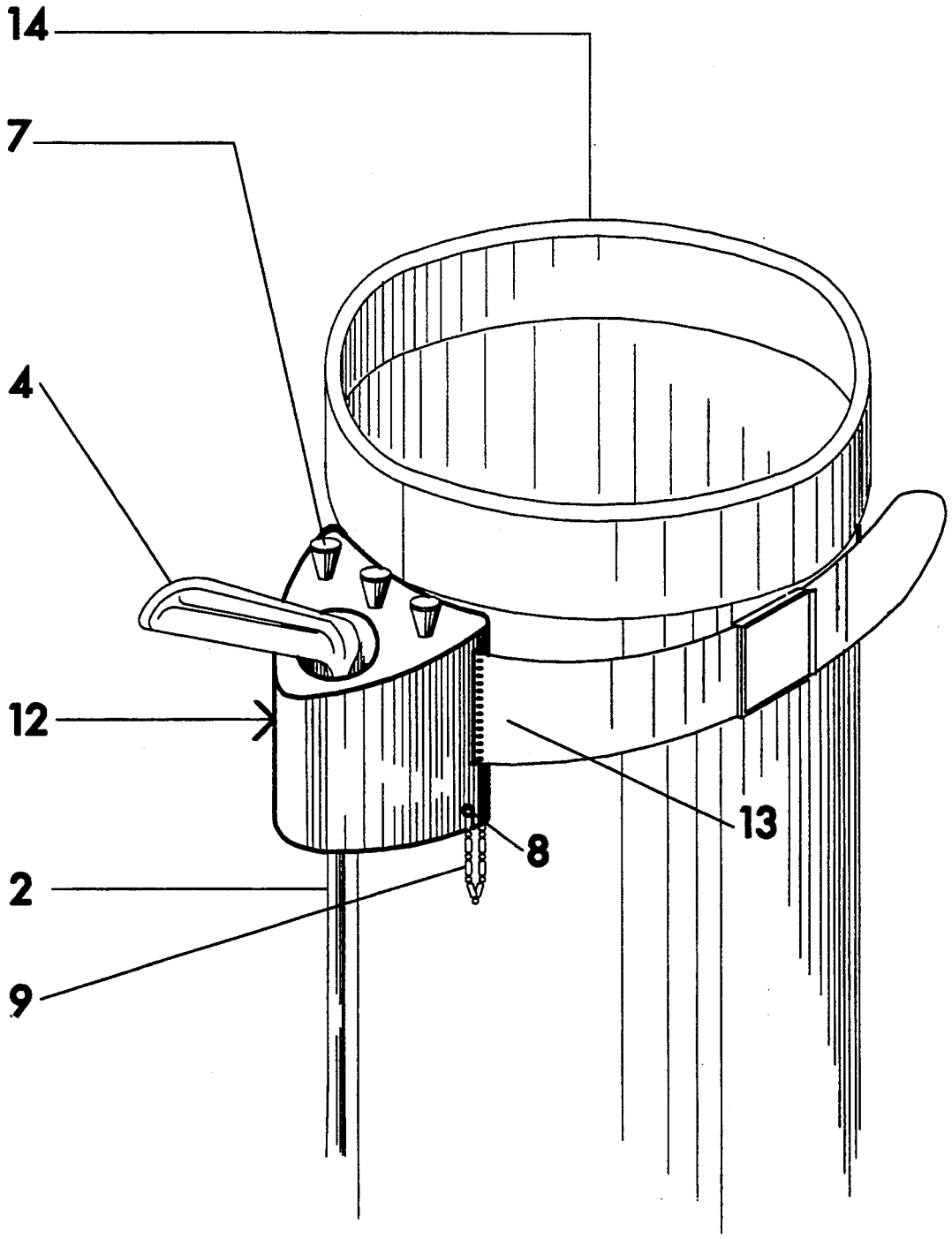
FIG. 2 shows the golf club carrier when attached to the belt or strap that holds the golf club bag securely to a motorized cart.

DESCRIPTION—FIGS. 1A, 1B and 2

The golf club carrier of the invention is distinguished from other devices because it is securely strapped to the golf cart when the bag is placed on the cart.

The golf club carrier will not become unhooked or bounced off the golf cart as other carriers described in prior art.

The golf club carrier is easily strapped to the cart before initiating the round of golf.

The golf club carrier provides ready access to the putter or other special golf club while keeping it protected from abrasions from other golf clubs.

Having the golf club outside the golf bag in the golf club carrier means selection of the club is easy and quick.

When the golf club carrier is not in use it slides easily off the unhooked cart strap for quick storage in one of the pockets of a golf bag.

The golf club carrier is useful for either pull carts or motorized carts.

The golf club carrier has a contoured lip for easy entry of the golf club handle and is shaped to fit snuggly to the golf bag when the cart strap is tightened.

With reference to the figures, FIG. 1A and 1B show the golf club carrier and FIG. 2 shows the golf club carrier in a mounted position. The golf club carrier 10 has a tubular tubular hole 1 to hold the golf club shaft 2. The golf club club carrier 10 is made of colored, soft, strong plastic or moulded rubber and has a contoured lip 3 to hold the head of the golf club 4 in a secure fashion. The slot hole 5 in the golf club carrier 10 is where the golf cart strap 13 is placed to hold the golf club carrier 10 in the mounted position on the golf cart. The golf club carrier 10 has a curved side 15 to provide added stability when mounted on the golf cart. The holes 6 on the top of golf club carrier 10 hold golf tees 7 for easy access. The hole 8 at the bottom of the golf club carrier 10 is for a chain 9 or clip to hold an accessory such as a towel or identification.

FIG. 2 shows the golf club carrier 10 in a mounted position 15 on a golf cart next to a golf bag 14.

SUMMARY, RAMIFICATIONS, AND SCOPE

Accordingly, the reader will see that the golf club carrier of the invention is a very useful device to hold a special golf club such as a putter for easy access for the player.

More than one golf club carrier can be strapped to a golf cart thus providing easy access to multiple golf clubs. The method of attachment of the golf club carrier lends itself for use with manual pull carts as well as motorized carts as they both use straps to mount the golf bags.

This invention keeps the special golf club away from the other clubs thus providing an abrasion free environment. It also provides the special club secure placement when in use and is easily stored when not in use.

Although the description above contains many specificities these should not be construed as limiting the scope of the invention but as merely providing illustrations of some of the presently preferred embodiments of this invention. For example, the golf club carrier can be other shapes and be of a different size. In the future this device could also be moulded onto the strap of the bag holder by the original equipment manufacturer.

Thus the scope of the invention should be determined by the appended claims and their legal equivalents, rather than by the examples given.

We claim:

1. A golf club carrier adapted to be attached to a strap on a golf cart wherein the carrier comprises:

a body having a vertical central axis, said body having a bottom wall with an outer peripheral edge, an upper wall with an outer peripheral edge and a continuous side wall interconnecting said outer edge of said upper wall with said outer edge of said lower wall and having a portion thereof curved inwardly toward said central axis to complementally fit on said strap;

an aperture sized to receive a shaft of a golf club and extending through said body parallel to said central axis, said upper wall slanting downwardly from said curved portion to hold a head of a golf club stationary; and a slot extending through said body along said curved portion of said side wall and terminating in openings in opposite portions of said side wall, said slot adapted to receive said strap to thereby mount the carrier on said golf cart.

2. A golf club carrier according to claim 1 wherein said upper wall includes at least one additional aperture therein which is adapted to receive a golf tee.

3. A golf club carrier according to claim 1 wherein said side wall includes at least one additional slot therein for enabling additional items to be mounted to the carrier.

4. A golf club carrier according to claim 1 wherein said carrier is made from a soft, semi-flexible material.

* * * * *